United States Patent [19]

Fraas

[11] 3,988,240

[45] Oct. 26, 1976

[54] ALTERNATING FIELD MAGNETIC SEPARATOR

[75] Inventor: Foster Fraas, Hyattsville, Md.

[73] Assignee: The United States of America as represented by the Secretary of the Interior, Washington, D.C.

[22] Filed: Apr. 5, 1973

[21] Appl. No.: 348,381

[52] U.S. Cl. ..... 209/214; 209/217; 209/222; 209/227; 210/222

[51] Int. Cl.[2] ..... B03C 1/00

[58] Field of Search ..... 209/222, 227, 214, 232; 210/222, 223, 217, 219, 220

[56] References Cited

UNITED STATES PATENTS

| | | | |
|---|---|---|---|
| 817,399 | 4/1906 | Snyder | 209/214 |
| 1,066,619 | 7/1913 | Isbell | 209/227 |
| 1,729,589 | 9/1929 | Mordey | 209/214 |
| 2,074,085 | 3/1937 | Frantz | 209/222 X |
| 3,326,374 | 6/1967 | Jones | 209/232 X |
| 3,375,925 | 4/1968 | Carpenter | 209/214 |
| 3,552,564 | 1/1971 | Burgener | 209/214 |
| 3,676,337 | 9/1972 | Kolm | 210/42 |
| 3,822,016 | 7/1974 | Jones | 209/223 R |
| 3,838,773 | 10/1974 | Kolm | 209/223 R X |

FOREIGN PATENTS OR APPLICATIONS

| | | | |
|---|---|---|---|
| 215,362 | 6/1958 | Australia | 209/214 |
| 105,831 | 9/1898 | Germany | 209/222 |

OTHER PUBLICATIONS

U.S. Bu. of Mines RI 6722, 1966.

*Primary Examiner*—Robert Halper
*Attorney, Agent, or Firm*—Gersten Sadowsky; Donald R. Fraser

[57] ABSTRACT

A magnetic matrix separator for selectively separating diverse particles subjects the particles to the interaction of vibratory and magnetic forces induced conjointly by the application of an intensified intermittent or alternating magnetic flux to the matrix. Continuous, dual separating actions are obtained with a flexibly mounted circular matrix structure caused to rotate with respect to the pole faces of a pair of U-shaped electromagnets. Use of a systematic arrangement of uniformly shaped matrix components facilitate rapid processing of the particles for separation.

14 Claims, 10 Drawing Figures

ALTERNATING FIELD MAGNETIC SEPARATOR

This invention relates to an improved matrix type-magnetic separator for the resolution of ores having a magnetic component into preselected components such as a desired magnetic fraction and a gangue fraction. A more complete separation is realized through use in this invention of pulsed magnetic fields which by agitating particles of the ores in a highly effective manner during separation avoid retention of some of the magnetic fraction with the nonmagnetic fraction.

Matrix type separators are characterized by the utilization therein of magnetic attractor units within a conduit through which particulate ores are channeled. Magnetizable elements of such units have heretofore been spatially arranged in this conduit to define interstices constituting tortuous passages for the ores. Disposition of the elements in a magnetic field gives rise to a magnetic flux in the passages such that magnetic particles of the ores are retained on the magnetized elements whereas the remaining nonmagnetic particles continue to pass completely through the conduit and into a collector. Magnetizable screens or vanes which are stacked to comprise the matrix of a separator applicable to the separation of iron bearing sand particles from particles of a glassware or pottery sand, have been described in patents to S. G. Frantz, Pat. No. 2,074,085, granted Mar. 16, 1937, and No. 2,331,769, granted Oct. 12, 1943. In the later patent sharp edged vanes are uniformly spaced and inclined in grids formed thereof which when stacked vertically are adapted to direct sand particles fed thereto from above in a serpentine path. The sharp edges of the vanes provide the maximum concentration of magnetic flux in the winding paths. Since the velocity of the material streams is reduced in these paths the effectiveness of the intensified flux to retain the magnetic fraction on the vanes is improved such that clean sand filtering through the grids can be more readily collected separately. At suitable intervals accumulations of contaminations are released from the vanes by demagnetizing them.

A continuously operable separator which in part incorporates the matrix separator principles previously identified, is described by the present inventor in his U.S. Bureau of Mines' Report of Investigations No. 6722, The Matrix-Type Magnetic Separator, published in 1966. The matrix it discloses is confined within an annular housing forming the rim portion of a disk mounted for rotation through slots in the spaced legs of oppositely poled electromagnets. Comprising this matrix are discrete fragments of ferromagnetic material having a low magnetic retentivity, such as spheres of annealed iron. Rotation of the disk causes the discrete portions of the annular housing to repeatedly traverse in sequence an area of maximum flux between opposing poles of the electromagnets, an area of zero flux between corresponding poles of one electromagnet, an area of maximum flux between further opposing poles of the electromagnets, and an area of zero flux between corresponding poles of the other electromagnet. Upper and lower walls of the annular housing are screens, or similar porous structures, through which feed and wash streams are directed. Thus, feed in water suspension is supplied to the upper screen at portions of the housing entering an area of maximum flux where on further displacement of such portions wash water is encountered which acts to complete removal of nonmagnetic particles of the feed away from magnetic particles adhering to fragments of the matrix now magnetized in the flux field. Nonmagnetic particles in wash water leaving the lower screen of the annular housing are received in a discharge launder positioned thereunder. Arrival of the aforesaid portions in the adjacent area of zero flux finds the matrix thereat ineffective to retain the magnetic particles thereon such than an application of wash water thereto removes the magnetic particles to a further launder below the housing. Upon entrance of the same portions in the further area of maximum flux they are again supplied with feed suspended in water, and thereafter met with successive streams of wash water which removes from the matrix thereat the nonmagnetic particles remaining in the maximum flux area, and subsequently the magnetic particles in the adjacent no flux area, as was previously explained. A dual separation action thus occurring concurrently in the pair of adjacent areas continues uninterruptedly as disk rotation of the annular housing takes the matrix through a circular path.

Modification in accordance with the present invention of a continuously operable magnetic matrix separator such as was heretofore considered adapts it for a unique utilization therein of alternating current magnetism. The potential utility of alternating currents in magnetic separators is the subject of an article entitled The Concentration of Minerals by Means of Alternate Electric Currents, by W. M. Mordey, appearing in The Mining Magazine, volume 26, of June 1922. Mordey takes cognizance of the dual actions of attraction and repulsion effects inherent in the use of alternating currents to produce magnetic flux for separator operation which follows, respectively, from the permeability and hysteresis present, and notes that the alternating current frequency and intensity can be controlled to determine the influence of these effects on the separation actions. However, some practical applications of the concepts treated in the article to ore-dressing by flotation in launders are mainly concerned with adaptations of the repulsion effect discussed rather than any attraction effect. A more elementary application of this repulsion effect to achieve separator action is the subject of patent No. 940,282, granted Nov. 16, 1909, to G. O. Rodgers, disclosing rotating electric fields, based on polyphase alternating current, which by inducing eddy currents in particles of metalliferous substances cause motions of these particles tending to carry them around the axis of the rotating field and away from non-metalliferous substances mixed therewith. Disclosure of an advanced separator apparatus in patent No. 1,564,731, granted Dec. 8, 1925, to J. Weatherby, for which a multi-phase alternating current is used to generate a rotating magnetic field, also identifies a repulsion effect as acting to remove nonmagnetic substances from a stream including magnetic substances. Several out-of-phase alternating currents are effective in Westherby's separator to produce a rotating magnetic field along a series of aligned teeth-like poles over which substances are advanced by resultant shifting and varying magnetic flux. Magnetic particles subject to this flux appear to bounce along a path following the poles while the nonmagnetic substances are repelled away from this path. Weatherby points out that separation is accomplished with no moving parts in the structure cooperatively associated with the field magnetic although a supply hopper for the apparatus includes a feeder plate which is vibrated in a conventional manner by a separate electromagnet. However, polyphase alternating current applications in concentrator apparatus disclosed in U.S. Pat. No. 1,417,189 granted May 23, 1922, to J. B. McCarthy, includes separating metallics conveyed in liquid by the action of rotating magnetic fields about windings on a plane ring core which draws towards the core the metallic fraction from the feed streamed therethrough. On the other hand, the invention disclosed herein employs intermittent or alternating current circuitry which functions to produce a pulsating magnetic field through a magnetic matrix structure wherein separation of magnetic from nonmagnetic substances is a result of action by the magnetic flux of the pulsating field to cause vibrations of the structure together with an attraction of the particles loosened thereby to magnetic elements of the matrix.

It is accordingly, an object of the present invention to provide a particle separator in which a magnetic matrix activated by an intensified intermittent or alternating magnetic flux is effective to engender multiple diverse forces which gives rise to the separation action.

The foregoing and other objects, features and advantages of the invention will become more apparent from the following particular description of preferred embodiments of the invention, as illustrated in the accompanying drawings wherein.

Figure 5:
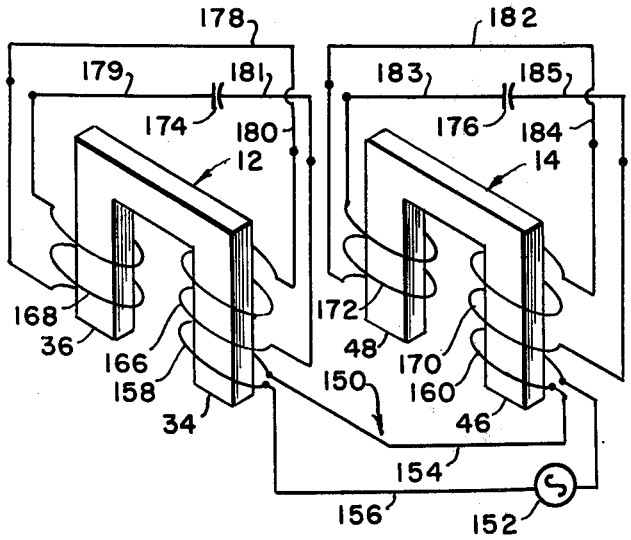
FIG. 5 is a simplified circuit diagram of the excitation and magnetization circuitry having utility in the separator of FIGS. 1 to 4.
Figure 5A:
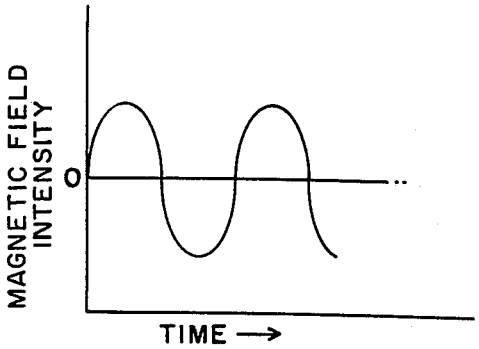

FIG. 5*a* graphically characterizes the magnetic flux intensity produced by the circuitry of FIG. 5.

Figure 6:
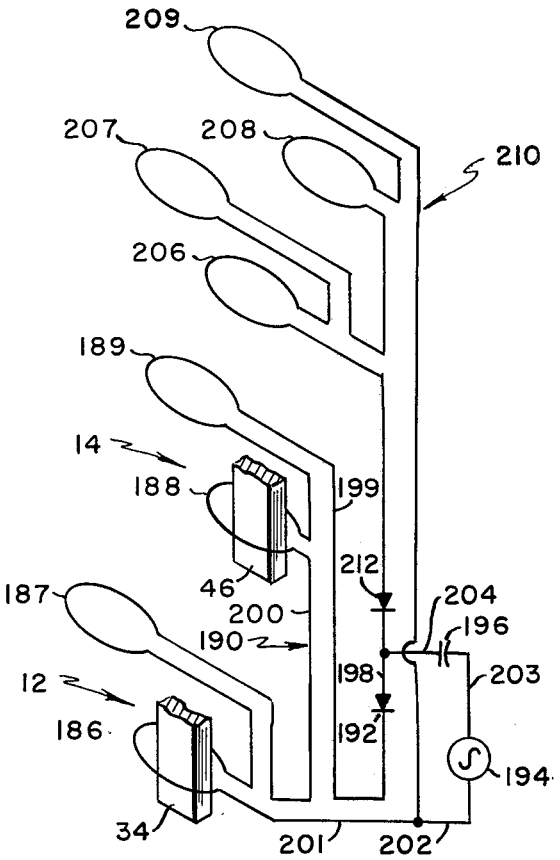
Figure 7:
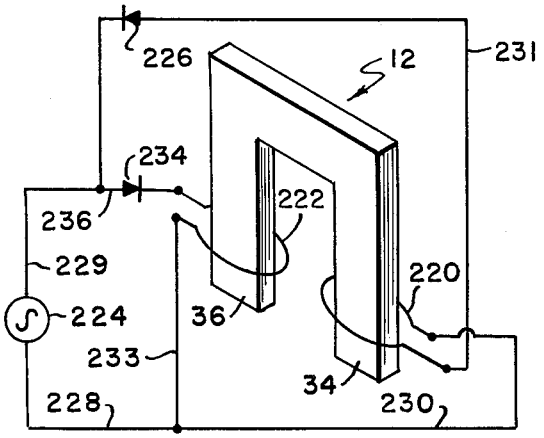

FIGS. 6 and 7 are simplified circuit diagrams of alternative forms of circuits having utility in activating the separator of FIGS. 1 to 4.

Figure 6A:
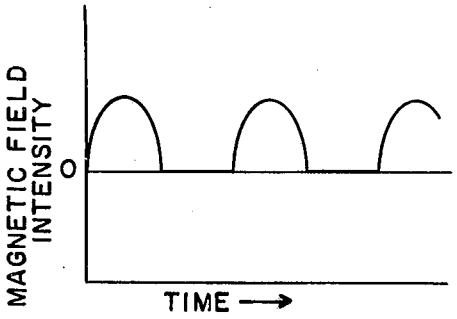
Figure 7A:
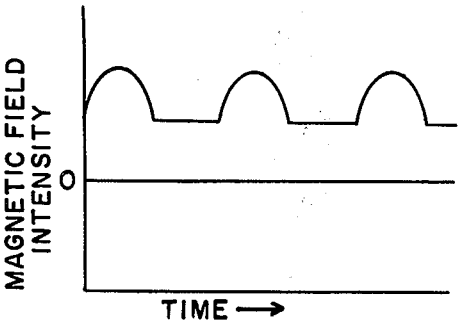

FIGS. 6*a* and 7*a* graphically characterize the magnetic flux intensity produced by the circuits of FIGS. 6 and 7, respectively.

Figure 1:
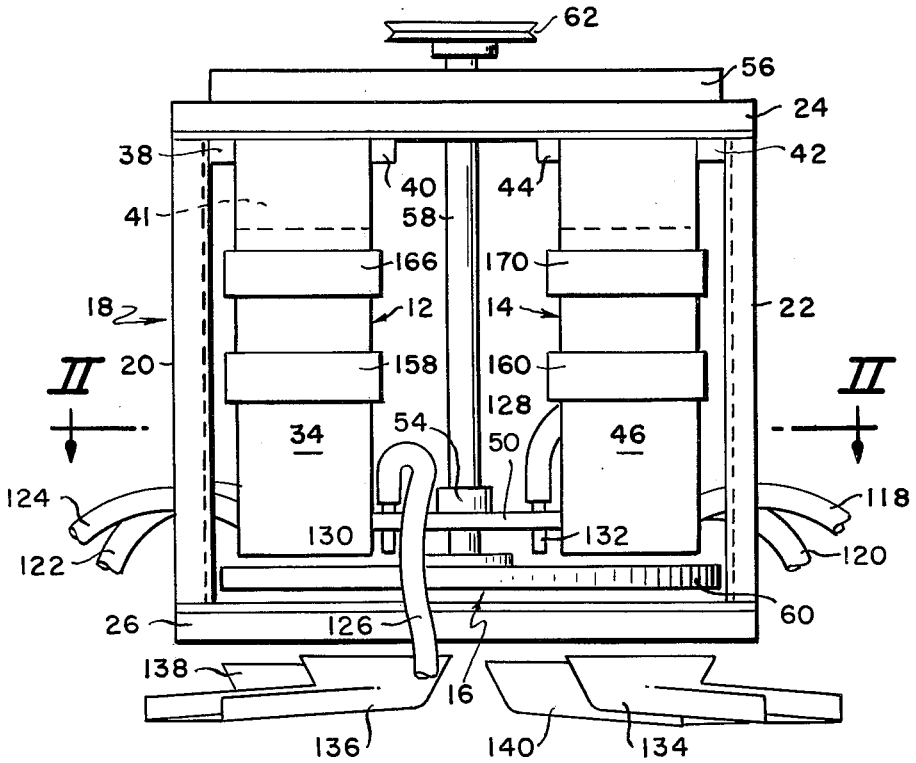
FIG. 1 is a generally diagrammatic elevational view of a separator according to the present invention.
Figure 2:
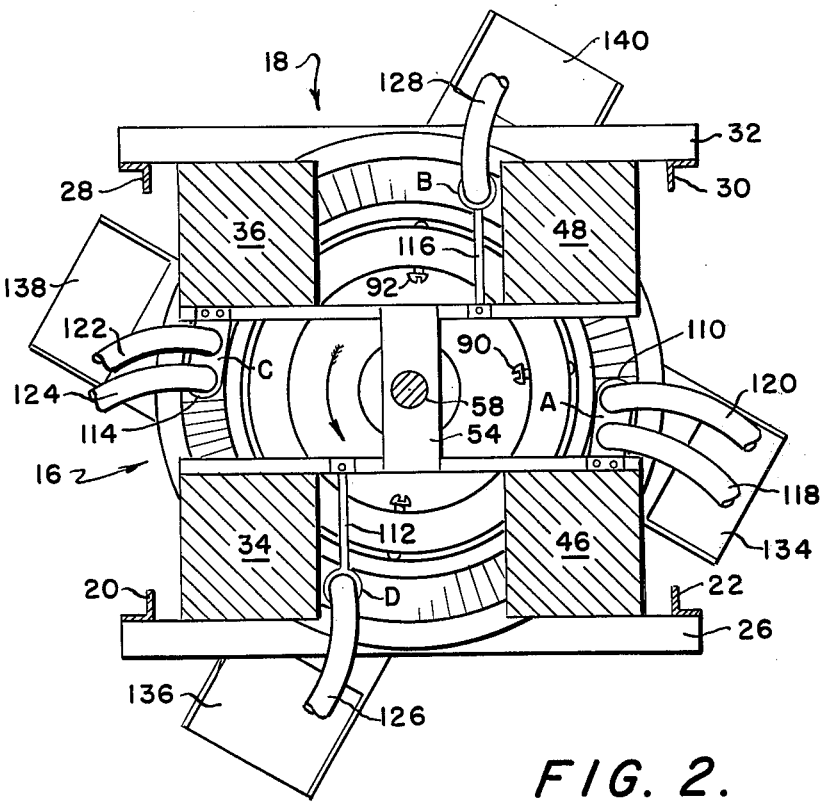
FIG. 2 is a plan sectional view of the separator of FIG. 1, taken along line II—II therein.

Reference to FIGS. 1 and 2 reveals a structural embodiment of the present invention in which a pair of inverted U-shaped electromagnets 12 and 14, and a particles feed transport arrangement 16, operatively associated therewith, are dependently maintained within a generally open framework construction constituting a basic support enclosure 18. One end of this enclosure is formed by vertically aligned, elongated members 20 and 22, which are squared off with upper and lower horizontal elongated members 24 and 26, and securely fixed thereat by connections with bolts or welds in overlapping surfaces of the several members adjacent to the extended ends thereof. Vertically aligned members 28 and 30 on the opposite end of frame 18 are similarly squared off with upper and lower elongated horizontal members and securely fixed therewith by bolts and welds, as more fully appears by reference to a lower member 32 thereof shown in FIG. 2. The several members of the framework construction thus formed are suitable lengths of structural aluminum angle bar millwork. Electromagnet 12 is characterized by spaced cores adapted to take opposite magnetic polarities at legs 34 and 36, thereof, respectively, which are downwardly directed at one side of frame 18 by the suspension of the electromagnet from between a pair of rectangular structural aluminum beams 38 and 40 which are horizontally disposed across the upper end of enclosure 18. In this connection, beams 38 and 40 have the wider sides thereof in contact with and fastened to respective opposite faces of a horizontal bridging portion 41 of the electromagnet, and the opposite end surfaces of these beams are securely fastened to upper frame member 24, and the corresponding upper frame member at the other end of enclosure 18, respectively. Connections heretofore described for beams 38 and 40 are duplicated at the sides and ends of a further pair of rectangular structural aluminum beams 42 and 44 to maintain electromagnet 14 suspended from an upper part of enclosure 18 such that spaced cores adapted to take opposite magnetic polarities at legs 46 and 48 of this electromagnet are directed downward at the other side of the framework. The spaced cores thus situated have a coordinated alignment with the cores at legs 34 and 36 of electromagnet 12. Increased structural rigidity is given enclosure 18 by horizontal structural steel cross bars 50 and 52 which, respectively, tie together cores of corresponding magnetic polarities at legs 34 and 36, and legs 36 and 48 of the electromagnets. Centrally disposed between electromagnets 12 and 14 is a rectangular aluminum plate 54 which overlies and attaches to cross bars 50 and 52. An elongated aluminum plate 56 is disposed to rest on upper surfaces of the electromagnets, and overlie edge portions of beams 38, 40, 42 and 44 to which the plate is attached in a position to extend midway between the opposite sides of enclosure 18. Similarly sized circular openings centered in these plates are axially aligned to accommodate journal portions of a rotatable steel shaft 58 which extends vertically from above plate 56 to below plate 54. A wheel-like structure 60 of particle feed transport arrangement 16 is affixed to the lower end of shaft 58 while the upper end of the shaft carries a pulley 62 having a conventional belt drive powered by a suitable motor. As will hereinafter be explained in further detail, shaft 58 is of such length as to accommodate wheel-like structure 60 at a short distance beneath the pole faces of electromagnets 12 and 14, whereat the wheel-like structure is rotatable in a horizontal plane by the pulley drive to shaft 58. Rotatable structure 60 is thus disposed to pass consecutive portions thereof through adjacent areas of contrasting flux densities which are to be found between pairs of cores having opposite and corresponding magnetic polarities at the legs of the electromagnets.

Figure 3:
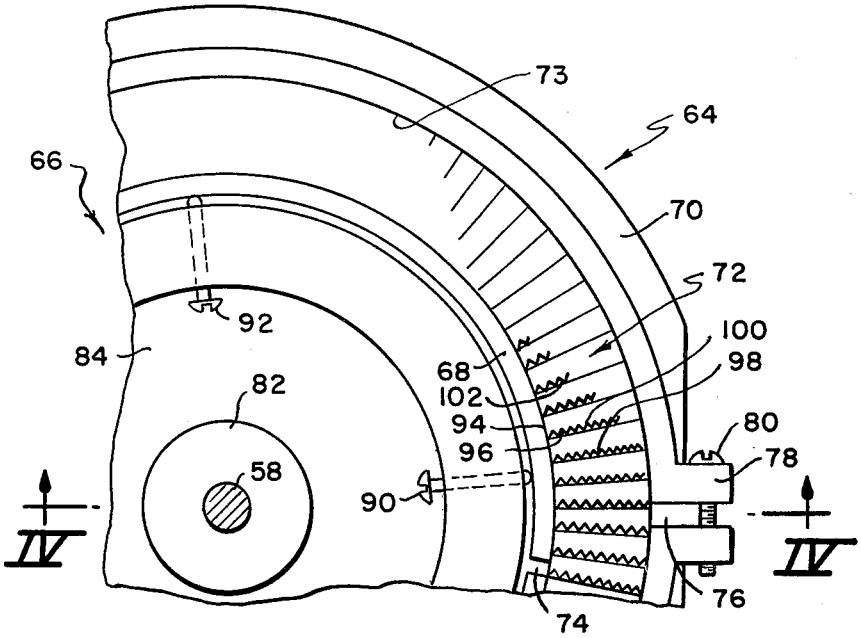
FIG. 3 is a fragmentary plan view of a rotatable carrier structure for a magnetic matrix having utility in the separator of FIGS. 1 and 2.
Figure 4:
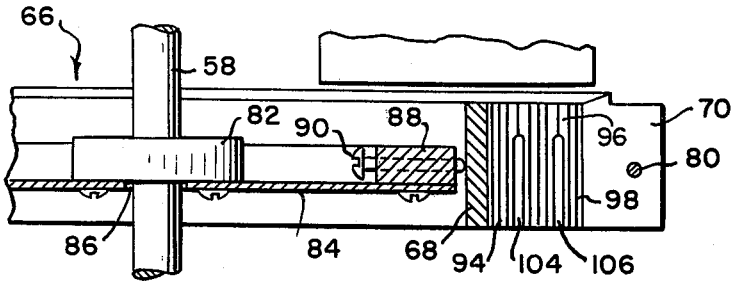
FIG. 4 is an elevational section view of the magnetic matrix carrier of FIG. 3, taken along the line IV—IV.

Reference to FIGS. 3 and 4 more fully reveals the form of wheel-like structure 60 as characterized by a rim assemblage 64 which is suspended on shaft 58 by a circular yoke assembly 66. Assemblage 64 forms a rim part for structure 60 by its inner and outer circular walls 68 and 70 when they are vertically and concentrically disposed about the axis of shaft 58. Inner surfaces of walls 68 and 70 are maintained uniformly separated by a matrix arrangement 72 which these walls confine within a circular aperture 73 defined therebetween. Inner wall 68 is a relatively wide horizontally disposed band of aluminum wherein a split provides a narrow vertical gap 74 which allows the band a degree of flexibility. Outer wall 70 is a similarly wide, but substantially thicker, band of aluminum wherein a split also provides a narrow vertical gap 76 which allows this thicker band a degree of flexibility. A threaded clamp fastener 78, fashioned at gap 76 by reduction of adjacent outer wall 70, constitutes the wall a hoop clamp made secure by a draw screw 80 of the fastening which is operable to adjust the gap. Inner wall 68 is retained upon yoke assembly 66 in such manner as to cause assemblage 64 to turn therewith upon rotation of shaft 58. Specifically, assembly 66 is affixed upon the body of shaft 58 by a keyed or screw connection between a steel hub collar 82 thereof and a lower segment of the shaft. To collar 82 is affixed a relatively stiff, though slightly flexible, thin circular suspension plate 84 in which a central opening 86 accommodates shaft 58 extending therethrough. Material for plate 84 may be a thin sheet of phosphor brass or stainless steel. Enabling the fixture of plate 84 to collar 82 is an annular portion of this plate defining the periphery of opening 86 which underlies an outer peripheral portion of collar 82, and has a ring of spaced holes taking screws which are secured by their engagement in correspondingly spaced threaded openings in the collar. To a relatively wide annular portion at the outer periphery of plate 84 is attached a ring-like collar 88 which is secured by screws extending through plate openings and engaged within axially aligned threaded openings circularly disposed about the collar. In addition, at least four radial holes generally equidistantly spaced around collar 88 are each threaded and has engaged therein an elongated screw, of which screws 90 and 92 appear in FIGS. 3 and 4. The elongated screws extend through the width of collar 88, and beyond its outer peripheral edge wherefrom they are adjustable into contact with inner wall 68 of assemblage 64. Consequently, displacements of the radial screws are adapted to spread wall 68 circumferentially at its gap 74, and thus obtain a compression between walls 68 and 70 which applies a vise-like grip upon matrix arrangement 72 when in place in aperture 73. Moreover, such forces as are then produced by the radial screws further act through their contact in collar 88 and at wall 68 to firmly hold assemblage 64 upon yoke 66.

Constituting matrix arrangement 72 are a multiplicity of correspondingly made particle feed receiving elements. Each of these elements is a generally square, tablet-like metal plate 94 having one face 96 covered with uniformly fashioned linear ridges 98 which extend in a vertical alignment such that an array of linearly aligned V-shaped grooves 100 are formed across face 96, and its other face 102 present a totally plane surface. Plates 94 are made of ferromagnetic material having low magnetic retentivity. Characterizing the thickness of each plate between the edges thereof extending parallel to the linear alignments on face 96 is a taper which facilitates stacking the plates in a closely fitted radial pattern filling circular aperture 73 in a manner best understood by reference to the showing thereof in FIG. 3. It will be seen in this figure that the stacking thus holds each plate such that every ridge 98 thereof makes contact with the contiguous plane face 102 of the following plate. At evenly spaced locations on each plate are added narrow slots 104 and 106, having openings through the lower edge of the plate, adapted to reduce eddy current losses. Evident now from the foregoing is that the body of matrix arrangement 72 is initially assembled between concentrically maintained walls 68 and 70 by inserting each plate 94 in annular aperture 73 so as to develop a ring of vertically disposed, radially extending plates, having the facial relationship heretofore described, which fills the aperture. Screw 80 is finally adjusted at fastener 78 so as to draw wall 70 tightly about the ring of plates in completing rim assemblage 64. Thereafter, rim assemblage 64 is placed about yoke collar 88 such that radial screws 90, 92, and the other like screws in the collar are in position to reach rim wall 68 about halfway between the wall's upper and lower edges. Subsequently, further adjustments of the radial screws are made to obtain a uniformly disposed, compact formation for rim assemblage 64, and provide the requisite suspension of assemblage 64 from yoke assembly 66.

A sphere matrix similar to the matrix described in the aforementioned Report of Investigations No. 6722, also has utility in the present invention. As was previously indicated, such spheres are retained between screens constituting upper and lower porous walls of an annular housing. Side walls of this housing are bands which correspond to walls 68 and 70, previously described, and correspondingly function to compact the matrix elements into a requisite annular form, whereas by attachment to the upper and lower edges of such walls are coordinately disposed the aforesaid screens which facilitate intake and discharge with respect to the matrix. However, in this instance, the housing is cooperatively associated with suspension plate 84 by engagement at the inner side wall thereof of the elongated screws acting through retainer collar 84 of the suspension plate in a manner hereinbefore described for mounting rim assemblage 64 as shown in FIGS. 3 and 4.

As was previously indicated, particles to be processed in the separator are maintained suspended in water which is fed to particle transport arrangement 16 from above at several stations between the legs of the respective electromagnets 12 and 14 shown in FIGS. 1 and 2, and distinct fractions of this feed dispersed in additional water fed from above and are discharged below arrangement 16 at other such stations. In accomplishing the foregoing use is made of relatively large diameter hoses equipped with elongated, generally wide mouth nozzle parts. These hoses are operatively maintained by conventional clamps at their nozzle parts which are mounted in bracket arms 110 and 112, and 114 and 116, supported by attachments to internal cross-bars 50 and 52, respectively. The respective bracket arms are thus located at the aforementioned stations where they are applicable to appropriately situate the nozzle parts immediately above rim assembly 64 of the transport arrangement to facilitate the particle separation action therein to be hereinafter more fully described. A first opening in bracket 110 supports a hose 118 from which a nozzle, not shown, projects downward to within a fraction of an inch above the upper edges of several adjacent plates 94 of matrix arrangement 72, and a further adjacent opening in the bracket supports a second hose 120 having a similar nozzle also set close to the matrix plates. A corresponding structure of bracket arm 114 also provides dual openings wherein a pair of hoses 122 and 124 are held so as to situate their associated nozzles, not shown, close-by the exposed upper edges of several adjacent plates 94 of the matrix arrangement. On the other hand, bracket arms 112 and 116 have singular openings in extended portions thereof wherein are secured hoses 126 and 128, respectively, from which the respective nozzles 130 and 132 project downward to within a short distance from plates 94 of the matrix arrangement at stations between electromagnets 12 and 14. The aforesaid fractions of the feed, and water in which they are dispersed, leave transport arrangement 16 at the lower edges of matrix plates 94 and are received in funnel-like launders 134, 136, 138 and 140, which are suitably situated below the matrix plates to accommodate fluid output at the stations identified with the hoses supported by brackets 110, 112, 114, and 116, respectively.

Magnetization of electromagnets 12 and 14 is produced with excitation by alternating or intermittent current, in circuitry such as illustrated in FIGS. 5 to 7, which induces corresponding alternating or intermittent magnetic fields between pole faces of the respective electromagnets. Energization of the circuitry which appears in FIG. 5 is through a power circuit 150 including an a.c. source 152, and leads 154 and 156 serially connecting drive coils 158 and 160 which are made applicable to legs 34 and 46, respectively, of the respective electromagnets. Magnetically coupled with the respective drive coils are separate magnetizing circuits 162 and 164, provided for electromagnets 12 and 14, respectively, which include for use on the opposite legs 34 and 36 of electromagnet 12, reversely wound coils 166 and 168, respectively, and on the opposite legs 46 and 48 of electromagnet 14, reversely wound coils 170 and 172, respectively. A separator apparatus having the circuitry of FIG. 5, thus has operable therein an alternating magnetic flux field which, as shown in FIG. 5*a*, is characterized by a sine wave relationship between magnetic field intensity and time. The high reactive power normally associated with such magnetizing circuits, due to the high inductive loading in electromagnetic cores which is characterized by a leading voltage out-of-phase current and voltage, is compensated for in the circuitry of FIG. 5 by series connected power factor correction capacitors 174 and 176 in circuits 162 and 164, respectively. Thus, leads 178 to 181 of magnetizing circuit 162 are provided to connect capacitor 174 with coils 166 and 168, and leads 182 to 185 of magnetizing circuit 164 are provided to connect capacitor 176 with coils 170 and 172. The value of the capacitance for these magnetizing circuits is conventionally determined for series resonance in the circuit wherefore the resultant reactance is zero and applied voltage is in phase with the current. However, resonance achieved through the use of capacitance in parallel connections is also contemplated, although that expediency would act to reduce input current instead of input voltage.

Circuitry appearing FIG. 6 provides intermittently induced magnetic fields which have application to two different separators. In this instance, serially connected driving coils 186, 187 and 188, 189 are provided in a circuit 190 to intermittently magnetize electromagnets 12 and 14, respectively, with half wave rectified current. In this instance an intermittent magnetic flux field having utility in the separator apparatus is characterized by the unidirectional pulse form shown in FIG. 6*a*. The requisite unidirectional power thus made effective in circuit 190 is achieved by way of a diode 192 which is serially connected to an a-c source 194 and a surge smoothing and power factor correcting capacitor 196, by way of leads 198 to 204. Other driving coils 206, 207 and 208, 209 which are serially connected in a parallel half wave rectifying circuit 210, are adapted to energize magnetizing circuits of the further separator. A diode 212 is directionally disposed in parallel circuit 210 so as to pass current on the half wave from a-c source 194 which is ineffective in circuit 190 such that the different separators are intermittently energized out-of-phase.

An increased magnetizing current for a separator is achieved with the circuitry of FIG. 7 which when operational takes into account an effective residual magnetism of the U-shaped magnet cores adapted for use in the apparatus heretofore disclosed. The circuit for electromagnet 12 shown in the figure, and which is to be duplicated for electromagnet 14, provides oppositely wound coils 220 and 222 for legs 34 and 36, respectively, of the electromagnet. An a-c source 224 is serially connected, by way of leads 228 and 229, with coil 220 and a diode 226, through circuit connections including leads 230 to 232, and with coil 222 and an oppositely directed diode 234, in parallel circuit connections including leads 234 to 236. Accordingly, each leg is subject to power having half wave rectification, and an intensified magnetic flux arises between the legs by reason of the adding flux of oppositely wound coils 220 and 222. Moreover, due to the presence of residual flux at the cores of the respective legs the overall effect is a pulsating magnetic field on top of a constant magnetic field plateau as indicated by the showing of FIG. 7*a*.

Preparative to initiating a separation operation of the apparatus disclosed herein, alternating or intermittent fields of magnetic flux are induced between legs 34 and 36 of electromagnet 12, and between legs 46 and 48 of electromagnet 14, by activation of energization and magnetizations circuits associated therewith as described with reference to FIGS. 5 to 7, while drive applied to shaft 58 by way of pulley 62 effects a steady rotation of particle transport arrangement 16 under the pole faces of these electromagnets. Rotation of transport arrangement 16 in the direction of the arrow shown in FIG. 2 is then effective to continuously displace matrix arrangement 72, and thereby carry the vertical channel-like passages of matrix plate grooves 100, through a predetermined sequence of operational stations under the nozzles of the hoses affixed in brackets 110, 116, 114, and 112, designated A, B, C, and D, respectively, in the drawing. Accordingly, in the ensuing operation, feed of magnetic and nonmagnetic particles in water suspension is caused to flow in hoses 118 and 122 while hoses 120, 124, 126, and 128 conduct flows of water alone to their respective nozzles. Since station A is in the area of peaking maximum magnetic flux at electromagnet 14, and all matrix plates 94 while in this area remain highly magnetized, the magnetic particles fraction of the flow from hose 118 then present in plate passages approaching the nozzle of hose 120, are drawn away from the particles of the nonmagnetic fraction by magnetic attraction and caused to cling to plates 94 at the surfaces thereof defining grooves 100. Under these circumstances this particle separation is significantly enhanced by a magnetically induced vibration of rim assemblage 64 upon its yoke assembly 66 which is made possible by the inherent flexibility of yoke suspension plate 84. This vibration follows from the upward thrusts exerted on the magnetically susceptible plates 94 of matrix arrangement 72 when magnetic flux is peaking. Also at the same time there is effective in the affected plate passages an intensification of a preferential lift of the magnetic particles from nonmagnetic particles then being carried downward with water in which they are suspended. Moreover, the water from hose 120 shortly thereafter impinges on the affected passages when the appertaining plates pass under that hose during continued rotation of rim assemblage 64, and adds its force to the downward flow. Further facilitating separation is a higher magnetic intensity in the matrix interstices of grooved plates than is present between the magnetic poles alone due largely to the current intensification enabled by energization circuitry disclosed herein as applicable to activate electromagnets 12 and 14. A more complete separation and retention of the magnetic fraction is therefore achieved in the grooves of the plates departing station A, whereas the water supplied by way of hoses 118 and 120 together with all nonmagnetic particles carried therein are discharged from lower openings of the grooves and into launder 134 arranged thereunder.

Upon arrival at station B matrix plates 94 lose their magnetism in the effectively zero magnetic flux environment at this station between corresponding polarity legs 36 and 48 of the respective electromagnets. Thus, when plates 94 whose matrix passages are burdened with magnetic particles reaches station B, such particles can no longer be retained by magnetic attraction and water flowing from nozzle 132 is effective to wash the magnetic particles from the passages and into separate launder 140 positioned thereunder. Since the operational events at stations C and D duplicate those previously described with respect to stations A and B, it will be evident that particles fed suspended in water by the nozzle of hose 122 to the passages of each plate 94 brought adjacent thereto also undergoes separation into a magnetic fraction, which clings by magnetic attraction to the groove surfaces of such plates then residing in an intensified magnetic field, and a nonmagnetic fraction which is subsequently washed completely through the passages with the aid of water from hose 124, and picked up in launder 138. And further, the magnetic particles in these passages upon reaching station D are freed from magnetic attraction in the absence of any effective magnetic flux field thereat, and are washed from the passages, by water from nozzle 130, into separate launder 136. Consequently, continuing regular operation of the separation apparatus according to the present invention provides concurrent dual separation sequences, wherein all operational elements of each sequence continue uninterruptedly such that steady streams of feed input to stations A and C of the apparatus produce steady outputs of their magnetic and nonmagnetic fractions at stations B and D and stations A and C, respectively.

Improved dry magnetic separation is also attained in accordance with the present invention. In an exemplary modification of the embodiment of the invention shown in FIGS. 1 to 4 which is adapted for use in dry magnetic separation, all hoses and their nozzle parts are removed and bracket arms 110 and 114 function to support conventional funneling devices which are thus positioned to direct dry feed to the rotating matrix at the stations A and C indicated in FIG. 2. The upwardly disposed wide ends of such funnels are respectively situated beneath the discharge ends of separate downwardly inclined chutes or launder structures which may have, as required, attached thereto in a conventional manner vibrator mechanisms known to the art. Separation between the magnetically and nonmagnetically susceptible particles of the dry feed thus funneled into the moving matrix is effectuated in essentially the manner previously described with respect to the feed in a fluid medium. Nonmagnetic fractions of the feed traverse the passages of the matrix elements moving in the magnetic flux induced between legs 34 and 36, and between legs 46 and 48 of electromagnets 12 and 14, respectively, whereas magnetic fractions are released from the matrix elements moving in the spaces between the electromagnets at stations B and D which are effectively free of magnetic flow. The completeness of the discharge of both nonmagnetic and magnetic fractions of the dry feed at their respective stations is significantly enhanced by the previously described magnetically induced vibration of rim assemblage 64 arising from the use of intermittent or alternating magnetic fields, and facilitated by the flexibility of suspension plate 84. This vibration is also instrumental in enabling the more complete separations achieved in an embodiment of the present invention having a rim housing matrix of spherical elements or the like. Nevertheless, there is an advantage in using the grooved plates shown in FIGS. 3 and 4 in that the particles pass through the matrix in a shorter time. Moreover, the high flow rate of the grooved plates is increased further where feed is in a fluid medium if suction chambers are operatively arranged at the discharge areas beneath the matrix in a manner similar to conventional applications with continuous vacuum filters.

Utilization of the intermittent magnetic field described herein was demonstrated to significantly increase the completeness of the discharge of the magnetic fraction from a particle feed as fine as 325 mesh over that which could be achieved using a constant field magnetic flux on such particle feed. With respect thereto, the data in the following Tables 1 and 2 from tests using constant and intermittent magnetic flux, respectively, induced by the same average current of 10.5 amperes through the magnetizing coils of each magnet in circuitry such as shown in FIG. 6, and having operative therein a matrix consisting of 1/16 inch diameter steel spheres, indicates that a retained magnetic portion of the constant flux separation was effectively eliminated in the separation by the intermittent magnetic flux.

TABLE 1.

Separation of pyrrhotite-quartz with a constant field

| | Weight, percent | Composition, percent Fe | Pyrrhotite[1] | Percent of total pyrrhotite |
|---|---|---|---|---|
| Nonmagnetic discharge | 60.9 | 4.92 | 8.34 | 13.7 |
| Magnetic discharge | 9.5 | 48.12 | 81.6 | 21.0 |
| Magnetic retained | 29.6 | | | 65.3 |
| Total | 100.0 | 21.8 | 36.9 | 100.0 |

[1]Pure pyrrhotite by chemical analysis contains 59.0 percent Fe.

TABLE 2.

Separation of pyrrhotite-quartz with an intermittent magnetizing current

| | Weight, percent | Composition, percent Fe | Pyrrhotite | Percent of total pyrrhotite |
|---|---|---|---|---|
| Nonmagnetic discharge | 56.7 | 9.73 | 16.5 | 20.6 |
| Magnetic discharge | 43.3 | 49.01 | 82.2 | 79.4 |
| Total | 100.0 | 26.7 | 45.3 | 100.0 |

In the two short period comparative tests the wash water for removing the magnetic fraction was the same and of a quantity which permitted complete discharge with the intermittent field, and partial removal with the constant field. Magnetic fraction retained with the constant field was determined after the test was completed by a large increase in the intensity of flow volume which would not be practical for normal operation.

Results of the separation of several mineral combinations in the size range of minus 200 plus 325 mesh are summarized in tables 3 and 4. Table 3 illustrates the dry separation of $\alpha Fe_2O_3$ from quartz with one pass through a matrix of ⅛ inch diameter steel spheres using the alternating current circuit of FIG. 5.

TABLE 3.

Separation of $\alpha$ $Fe_2O_3$-quartz with a 60Hz magnetizing current[1]

| Fraction | Weight, percent | Composition, percent Fe | Percent of total Fe |
|---|---|---|---|
| Nonmagnetic | 36.6 | 9.3 | 8.1 |
| Intermediate | 14.4 | 48.7 | 16.7 |
| Magnetic | 49.0 | 64.4 | 75.2 |
| Total | 100.0 | 42.0 | 100.0 |

[1]Specular $\alpha$ $Fe_2O_3$ when pure contains 70 percent Fe. 10 ampere current in 523 wire turns per magnet core.

Reference to the aforementioned Report of Investigations No. 6722, indicated that the results are equal to what can be obtained in wet separations.

One advantage of dry separations is that the added expense of thickeners and other solid-liquid separation devices is avoided.

Application of a partially modulated field using the circuit of FIG. 7, and the grooved plate matrix of FIGS. 3 and 4 is illustrated in table 4 in a one pass dry separation of ilmenite from quartz.

TABLE 4.

Separation of ilmenite-quartz with a partially modulated current and a grooved plate matrix[1]

| Fraction | Weight, percent | Composition percent Fe | ilmenite[2] | Percent of total ilmenite |
|---|---|---|---|---|
| Nonmagnetic | 48.8 | 0.19 | 0.5 | 0.5 |
| Magnetic | 51.2 | 37.7 | 99.0 | 99.5 |
| Total | 100.0 | 19.4 | 53.9 | 100.0 |

[1]12.75 amperes in 532 wire turns per magnet core.
[2]Identified as arizonite which theoretically contains 36.0 percent Fe. Chemical analysis Fe = 34.8 percent.

Intermittent current is also applicable to produce a magnetic flux for a cross-belt separator, such current being particularly effective where the magnetic and nonmagnetic fractions are entwined as in a matted or fibrous mass of copper needles. The resultant pulsating magnetic field has a separation effect similar to the pulsations in a hydraulic jig permitting the nonmagnetic copper filbers to sink back to the feed carrier belt, and the magnetic particles to rise to the cross carrier belt above. Among other fibrous materials which would benefit significantly from the aforementioned processing are minerals such as tremolite, actinolite, and chrysotile, and matted or fibrous secondary materials.

While particular embodiments of the present invention have been illustrated and described herein, it will be understood that this invention is not limited thereto, but is susceptible to change in form and detail.

What is claimed is:

1. Method of separately concentrating magnetic and non-magnetic fractions of a stream of particles wherein said fractions are commingled, and from said stream are supplied particles thereof as feed to a fraction separation zone subject to the establishment therein of a magnetic flux field, comprising the steps of conveying said feed by uniformly arranged, rigidly assembled, magnetically susceptible, flexibly supported transport means into said separation zone, and producing said magnetic flux field so as to continuously vary the intensity of said field in a regular cyclic manner such that said particles of said magnetic fraction are preferentially displaced in a substantially unidirectional path by intensification of said field, and said rigidly assembled, magnetically susceptible transport means immediately responds to the presence thereof in said varying magnetic flux field by undergoing constant vibrational thrusts including thrusts directionly coincidental with said unidirectional path when said particles of said magnetic fraction are preferentially displaced, whereby said preferential displacements of said magnetic particles are reinforced within a dispersement of said conveyed feed in said zone so as to enhance the completeness of said separate concentrations of said fractions.

2. Method of claim 1 wherein said magnetically susceptible transport means includes a plurality of magnetically susceptible elements among which are passages receiving said feed, further steps comprising effectuating said separation by retention of said particles of said magnetic fraction to surfaces of said elements in said passages moving through said magnetic flux field of said separation zone, and enhancing a discharge of particles of said nonmagnetic fraction to a collector means therefor as a result of said vibration of said transport, and conveying said retained particles of said magnetic fraction to a further zone outside of said magnetic flux field whereat said particles are free from said surfaces, and a discharge of said particles of said magnetic fraction to a further collector means is enhanced.

3. Apparatus for separately concentrating magnetically susceptible and unsusceptible particles commingled in a stream, said apparatus comprising stationary magnetic field producing means including electromagnet means providing a cyclically varying magnetic field within at least one predetermined area of said apparatus in response to said magnetic field producing means being activated by electrical circuitry having cyclically fluctuating power effective therein, displaceable container means fixedly confining therein a multiplicity of rigidly maintained magnetically susceptible discrete elements having conformations thereof providing a series of passages extending through said container means in a predetermined arrangement, driving means for displacing said container means having as an integral part thereof a flexible extension to which said container means is suspended, said container means being continuously displaced in response to activation of said driving means and is operable thereby to cyclically convey therewith said series of passages in a circuit between said one predetermined area and at least one further predetermined area of said apparatus outside said varying magnetic field, stream directing means guiding said particles therein into said series of passages reaching said one predetermined area whereat magnetization of at least one of said elements and said magnetically susceptible particles therein, and vibration of said suspended container resulting from the effect of said cyclically varying magnetic field on said elements, obtain a rapid adherence of said magnetically susceptible particles to passage defining surfaces of said one element whereas said magnetically unsusceptible particles flow through said series of passages and are discharged into a collector means provided therefor, and upon said series of passages reaching said further predetermined area whereat there is an absence of magnetization of any of said elements thereat, said magnetically susceptible particles transported in said series of passages from said one predetermined area are freed from adherence to said passage defining surfaces and left subject to said vibration whereby said magnetically susceptible particles discharge from said series of passages and into a further collector means provided therefor.

4. Apparatus in accordance with claim 3 wherein said magnetically susceptible elements are correspondingly shaped and have an array of uniform conformations thereon, and said elements are maintained where said conformations thereof are oriented to form at each said element a series of passages extending linearly through said container means.

5. Apparatus in accordance with claim 3 wherein said magnetically susceptible elements are correspondingly spherical in shape.

6. Apparatus for separately distributing magnetically susceptible and unsusceptible particles suspended in a stream of fluid, said apparatus comprising stationary magnetic field producing means including electromagnet means providing a cyclically varying magnetic field within at least one predetermined area of said apparatus in response to said magnetic field producing means being activated by electrical circuitry having cylically fluctuating power effective therein, displaceble container means confining therein a multiplicity of correspondingly shaped magnetically susceptible elements having an array of uniform conformations thereon, and said elements being thereby maintained where said conformations thereof are oriented to form at each of said elements a series of passages extending linearly through said container means, driving means for displacing said container means having as an integral part thereof a flexible extention to which said container means is suspended, said driving means comprises a circular support structure mounted on a rotatable shaft, said support structure including said flexible extension affixed to a hub-collar thereof, and said container means is an assemblage having inner and outer adjustable bands disposed to form a circular aperture and constituting on said driving means a rim structure which is removably secured to said flexible extension thereof, whereby confinement of said magnetically susceptible elements is effectuated by adjustments of said bands, said container means being continously displaced in response to activation of said driving means and is operable thereby to cyclically convey therewith each of said series of passages in a circuit between said one predetermined area and at least one further predetermined area of said apparatus outside said carrying magnetic field, fluid directing means guiding said stream of fluid having said particles therein into each of said series of passages reaching said one predetermined area whereat magnetization of at least one of said elements and said magnetically susceptible particles therein, and vibration of said suspended container resulting from the effect of said cyclically varying magnetic field on said elements, obtain a rapid adherence of said magnetically susceptible particles to passage defining surfaces of said one element whereas fluid from said stream and additional fluid, guided by further fluid directing means into said series of passages when said passages are conveyed further into said one predetermined area, wash said magnetically unsusceptible particles through said series of passages and into a collector means provided therefor, and still further fluid directing means guiding further fluid into each of said series of passages reaching said further predetermined area whereat absence of magnetization of any of said elements thereat, and said magnetically susceptible particles transported therein from said one predetermined area, frees said magnetically susceptible particles from adherence to said passage defining surfaces and allows said further fluid to wash said magnetically susceptible particles through said series of passages and into a further collector means provided therefor.

7. Apparatus in accordance with claim 6 wherein each said magnetically susceptible element is a plate having a plane side and a side opposite thereto characterized by said array of uniform conformations which define linear grooves thereon, said plates being arranged in said aperture such that each said plate contacts said conformation thereof with said plane side of a contiguous one of said plates whereby said series of linear passages are formed.

8. Apparatus in accordance with claim 7 wherein each of said plates is tapered between opposite edges thereof whereby said arrangement of plates for said contiguous contact obtains a radial disposition of said sides of said plates with respect to said rotatable shaft.

9. Apparatus for separately distributing magnetically susceptible and unsusceptible particles suspended in a stream of fluid, said apparatus comprising stationary magnetic field producing means including electromagnet means providing a cyclically varying magnetic field within at least one predetermined area of said apparatus in response to said magnetic field producing means being activated by electrical circuitry having cyclically fluctuating power effective therein, displaceable container means fixedly confining therein a multiplicity of correspondingly shaped rigidly maintained magnetically susceptible discrete elements having an array of uniform conformations thereon, and said elements being thereby maintained where said conformations thereof are oriented to form at each of said elements a series of passages extending linearly through said container means in a predetermined arrangement, driving means for displacing said container means having as an integral part thereof a flexible extension to which sad container means is suspended, said container means being continuously displaced in response to activation of said driving means and is operable thereby to cyclically convey therewith each of said series of passages in a circuit between said one predetermined area and at least one further predetermined area of said apparatus outside said varying magnetic field, fluid directing means guiding said stream of fluid having said particles therein into each of said series of passages reaching said one predetermined area whereat magnetization of at least one of said elements and said magnetically susceptible particles therein, and vibration of said suspended container resulting from the effect of said cyclically varying magnetic field on said elements, obtain a rapid adherence of said magnetically susceptible particles to passage defining surfaces of said one element whereas fluid from said stream and additional fluid, guided by further fluid directing means into said series of passages when said passages are conveyed further into said one predetermined area, wash said magnetically unsusceptible particles through said series of passages and into a collector means provided therefor, and still further fluid directing means guiding further fluid into each of said series of passages reaching said further predetermined area whereat absence of magnetization of any of said elements thereat, and of said magnetically susceptible particles transported therein from said one predetermined area, frees said magnetically susceptible particles from adherence to said passage defining surfaces and allows said further fluid to wash said magnetically susceptible particles through said series of passages and into a further collector means provided therefor.

10. Apparatus in accordance with claim 9 wherein said stationary magnetic field producing means comprises a first and a second U-shaped electromagnets providing cyclically varying magnetic fields, and which are spatially arranged in said apparatus to adjacently locate in pairs legs of corresponding magnetic polarity of the respective electromagnets whereby said first electromagnet forms a magnetic field in a gap between legs thereof of opposite magnetic polarity which constitutes said one predetermined area, and a space between legs of one of said adjacent pair thereof constitutes said one further predetermined area.

11. Apparatus in accordance with claim 10 wherein said second electromagnet forms a further magnetic field in a gap between legs thereof which constitutes a still further predetermined area of said apparatus, and a further space between legs of another of said adjacent pairs thereof constitutes a yet still further predetermined area of said apparatus, said container means being further operable by said driving means to cyclically convey therewith in said circuit thereof said series of passages between said still further predetermined area and said yet still further predetermined area, another fluid directing means guiding a further stream of fluid having said particles therein into each of said series of passages said still further predetermined area whereat magnetization of at least one other of said elements and said magnetically susceptible particles therein, and said vibration of suspended container resulting from the effect of said cyclically varying magnetic field on said elements, obtain a rapid adherence of said magnetically susceptible particles to passage defining surfaces of said one other of said elements whereas fluid from said further stream and other additional fluid, guided by still another fluid directing means into said series of passages when such passages are conveyed further into said further predetermined area, wash said magnetically unsusceptible particles through said series of passages and into another collector means provided therefor, and a yet still another fluid directing means guiding still further fluid into each of said series of passages reaching said yet still further predetermined area whereat absence of magnetization of any of said elements thereat and said magnetically susceptible particles transported therein from said still further predetermined area, frees said magnetically susceptible particles from adherence to said passage defining surfaces and allows said still further fluid to wash said magnetically susceptible particles through said series of passages and into a still another collector means provided therefor.

12. Apparatus for separately distributing magnetically susceptible and unsusceptible particles suspended in a stream of fluid, said apparatus comprising stationary magnetic field producing means including electromagnet means providing a cyclically varying magnetic field within at least one predetermined area of said apparatus in response to said magnetic field producing means being activated by electrical circuitry having cyclically fluctuating power effective therein, said magnetic field producing means comprising first and second electromagnets, and said electrical circuitry comprising an energization circuit including a source of alternating current power in serial connection with first and second windings constituting driving coils for said first and second electromagnets, respectively, and further first and second circuits operatively associated with said first and second electromagnets, respectively, each said further circuit including, in a serial connection with a capacitor, a pair of oppositely wound coils which are made applicable to said respective electromagnets for producing said magnetic field within said one predetermined area, and capacitance of said capacitor and inductance of said electromagnets are such as to establish resonance in said electrical circuitry whereby a peaking intensification of magnetization current is obtained to produce intensification of said cyclically varying magnetic field while minimizing reactive power in said circuitry, displaceable container means confining therein a multiplicity of correspondingly shaped magnetically susceptible elements having an array of uniform conformations thereof, and said elements being thereby maintained where said conformations thereof are oriented to form at each of said elements a series of passages extending linearly through said container means, driving means for displacing said container means having as an integral part thereof a flexible extension to which said container means is suspended, said container means being continuously displaced in response to activation of said driving means and is operable thereby to cyclically convey therewith each of said series of passages in a circuit between said one predetermined area and at least one further predetermined area of said apparatus outside said varying magnetic field, fluid directing means guiding said stream of fluid having said particles therein into each of said series of passages reaching said one predetermined area whereat magnetization of at least one of said elements and said magnetically susceptible particles therein, and vibration of said suspended container resulting from the effect of said cyclically varying magnetic field on said elements, obtain a rapid adherence of said magnetically susceptible particles to passage defining surfaces of said one element whereas fluid from said stream and additional fluid, guided by further fluid directing means into said series of passages when said passages are conveyed further into said one predetermined area, wash said magnetically unsusceptible particles through said series of passages and into a collector means provided therefor, and still further fluid directing means guiding further fluid into each of said series of passages reaching said further predetermined area whereat absence of magnetization of any of said elements thereat, and said magnetically susceptible particles transported therein from said one predetermined area, frees said magnetically susceptible particles from adherence to said passage defining surfaces and allows said further fluid to wash said magnetically susceptible particles through said series of passages and into a further collector means provided therefor.

13. Apparatus for separately distributing magnetically susceptible and unsusceptible particles suspended in a stream of fluid, said apparatus comprising stationary magnetic field producing means including electromagnet means providing a cyclically varying magnetic field within at least one predetermined area of said apparatus in response to said magnetic field producing means being activated by electrical circuitry having cyclically fluctuating power effective therein, said magnetic field producing means comprising first and second U-shaped electromagnets and said electrical circuitry comprising a magnetization circuit which functions to activate said electromagnets, said circuit further comprisng in a serial connection thereof a first diode and a capacitor, and has serially connected in a further circuit additional first and second windings constituting magnetization coils for other first and second electromagnets of a further apparatus and a second diode oppositely directed with respect to said first diode, which further circuit is connected across said serially connected capacitor and power source, whereby different alternate half cycles of current from said power source are effective to activate said magnetization circuit and said further magnetization circuit, respectively, displaceable container means confining therein a multiplicity of correspondingly shaped magnetically susceptible elements having an array of uniform conformations thereon, and said elements being thereby maintained where said conformations thereof are oriented to form at each of said elements a series of passages extending linearly through said container means, driving means for displacing said container means having as an integral part thereof a flexible extension to which said container means is suspended, said container means being continuously displaced in response to activation of said driving means and is operable thereby to cyclically convey therewith each of said series of passages in a circuit between said one predetermined area and at least one further predetermined area of said apparatus outside said varying magnetic field, fluid directing means guiding said stream of fluid having said particles therein into each of said series of passages reaching said one predetermined area whereat magnetization of at least one of said elements and said magnetically susceptible particles therein, and vibration of said suspended container resulting from the effect of said cyclically varying magnetic field on said elements, obtain a rapid adherence of said magnetically susceptible particles to passage defining surfaces of said one element whereas fluid from said stream and additional fluid, guided by further fluid directing means into said series of passages when said passages are conveyed further into said one predetermined area, wash said magnetically unsusceptible particles through said series of passages and into a collector means provided therefor, and still further fluid directing means guiding further fluid into each of said series of passages reaching said further predetermined area whereat absence of magnetization of any of said elements thereat, and said magnetically susceptible particles transported therein from said one predetermined area, frees said magnetically susceptible particles from adherence to said passage defining surfaces and allows said further fluid to wash said magnetically susceptible particles through said series of passages and into a further collector means provided therefor.

14. Apparatus for separately distributing magnetically susceptible and unsusceptible particles suspended in a stream of fluid, said apparatus comprising stationary magnetic field producing means including electromagnet means providing a cyclically varying magnetic field within at least one predetermined area of said apparatus in response to said magnetic field producing means being activated by electrical circuitry having cyclically fluctuating power effective therein, said magnetic field producing means comprising first and second U-shaped electromagnets, and said electrical circuitry comprising first and second magnetization circuits which function to activate said first and second electromagnets, respectively, each said magnetization circuit being connected to a source of alternating current power, and each comprising first and second oppositely wound driving coils which are operationally associated with first and second legs of a respective one of said electromagnets, and said first coil being serially connected with a first diode and said power source, and said second coil being serially connected with a second diode, which is oppositely directed with respect to said first diode, and said power source, displaceable container means confining therein a multiplicity of correspondingly shaped magnetically susceptible elements having an array of uniform conformations thereon, and said elements being thereby maintained where said conformations thereof are oriented to form at each of said elements a series of passages extending linearly through said container means, driving means for displacing said container means having as an integral part thereof a flexible extension to which said container means is suspended, said container means being continuously displaced in response to activation of said driving means and is operable thereby to cyclically convey therewith each of said series of passages in a circuit between said one predetermined area and at least one further predetermined area of said apparatus outside said varying magnetic field, fluid directing means guiding said stream of fluid having said particles therein into each of said series of passages reaching said one predetermined area whereat magnetization of at least one of said elements and said magnetically susceptible particles therein, and vibration of said suspended container resulting from the effect of said cyclically varying magnetic field on said elements, obtain a rapid adherence of said magnetically susceptible particles to passage defining surfaces of said one element whereas fluid from stream and additional fluid, guided by further fluid directing means into said series of passages when said passages are conveyed further into said one predetermined area, wash said magnetically unsusceptible particles through said series of passages and into a collector means provided therefor, and still further fluid directing means guiding further fluid into each of said series of passages reaching said further predetermined area whereat absence of magnetization of any of said elements thereat, and said magnetically susceptible particles transported therein from said one predetermined area, frees said magnetically susceptible particles from adherence to said passage defining surfaces and allows said further fluid to wash said magnetically susceptible particles through said series of passages and into a further collector means provided therefor.

* * * * *